United States Patent [19]

Livera et al.

[11] Patent Number: 4,787,865

[45] Date of Patent: Nov. 29, 1988

[54] THREE-WAY LAMP BASES AND METHOD FOR MAKING THEM

[75] Inventors: Phillip A. Livera, Cedar Groove; Paul P. Bracaglia, Fairfield, both of N.J.

[73] Assignee: North American Philips Lighting Corp., New York, N.Y.

[21] Appl. No.: 937,761

[22] Filed: Dec. 4, 1986

[51] Int. Cl.[4] ..... H01J 5/52

[52] U.S. Cl. ..... 439/614; 445/22; 445/27

[58] Field of Search ..... 445/26, 27; 65/49; 439/614, 615; 313/318

[56] References Cited

U.S. PATENT DOCUMENTS 2,975,556 3/1961 Baird ..... 65/49 X
3,148,305 9/1964 Pearson ..... 313/318

FOREIGN PATENT DOCUMENTS 683370 3/1964 Canada ..... 313/318

*Primary Examiner*—Kenneth J. Ramsey
*Attorney, Agent, or Firm*—Robert T. Mayer

[57] ABSTRACT

A base for three-way lamps in which it is easier to feed lead wires through and a method of making such bases.

10 Claims, 1 Drawing Sheet

THREE-WAY LAMP BASES AND METHOD FOR MAKING THEM

This is an invention in the lighting art. More particularly it involves a method of making novel three-way lamp bases and the bases made by the method.

This application is related to our concurrently filed application entitled "Tool For Making Three-Way Lamp Bases" assigned to the assignee of this application. That application is incorporated by reference herein.

The standard three-way lamp base has two wires coming out of its bottom. One of these is connected to an eyelet contact which is located at the center of the base. The other wire is off centered and connects to a contact ring which surrounds the eyelet and is insulated from it by glass. The aperture for feeding this off centered wire through the base is itself off centered. Because of this difficulties have been encountered in feeding this wire through its associated aperture.

It is an object of this invention to make it easier to manufacture three-way lamp bases.

One of the features of the invention is the novel form given the glass insulation in the base of a three-way lamp.

One of the advantages of the invention is that it makes it easier to feed a wire through the off centered aperture in the base of a three-way lamp.

In accordance with one aspect of the invention there is provided a new base for a three-way lamp. The base includes a tubular shell with an open bottom and a round wall disposed about a longitudinal axis. Glass insulation is in the bottom of the shell. The insulation has a first aperture in the center of the bottom of the base. A metal eyelet is imbedded in the glass insulation and located in the center of the base so that the center of the eyelet is aligned with the first aperture in the insulation. A contact ring surrounds the eyelet and is embedded in the insulation. The contact ring is separated from the eyelet and from the shell by the glass insulation. The contact ring has a radial wall of a predetermined width with an aperture in it. The insulation has a second aperture extending entirely through it and in line with the aperture in the contact ring. The second aperture is between the eyelet aperture and the round wall of the shell. The glass insulation has a depth between the contact ring and the shell. The second aperture in the insulation has a cross-section perpendicular to the longitudinal axis of the shell. This cross-section by design has a longer circumferential dimension than the radial one.

In accordance with another aspect of the invention there is provided a method of manufacturing a base for a three-way lamp. The method includes orienting a tubular shell with an open top and bottom and a round wall disposed around a longitudinal axis with its top up in a prescribed mold. An eyelet is located in the mold in the center of the shell and below its bottom by a predetermined distance. A contact ring is located in the mold around the eyelet and separated from it. The contact ring has a radial wall with an aperture in it and is located a fixed distance below the bottom of the shell. This fixed distance is less than the predetermined distance the eyelet is below the shell. A predetermined amount of molten glass is deposited into the shell. A metal plunger presses into the shell to force glass in a prescribed manner around the eyelet, between the eyelet and the contact ring and between the contact ring and the bottom of the shell. The plunger forms a recess in the glass axially in line with the aperture of the eyelet and another recess in line with the aperture in the radial wall of the contact ring. The recess in line with the aperture in the radial wall of the contact ring has a cross-section perpendicular to the longitudinal axis of the shell which cross-section has a circumferential dimension longer than a radial one.

Other objects, features and advantages of the invention will be apparent to those skilled in the art from the following description when considered in conjunction with the appended claims and the accompanying drawing in which:

FIG. 1*a* shows the base of a prior art glass plunger used in making three way lamp bases;

FIG. 1*b* is a longitudinal cross-section of the prior art plunger of FIG. 1*a;*

FIG. 2*a* shows the base of a novel plunger used in making the novel three-way lamp bases of the invention;

FIG. 2*b* is a longitudinal cross-section of the plunger of FIG. 2*a;*

Figure 1A:
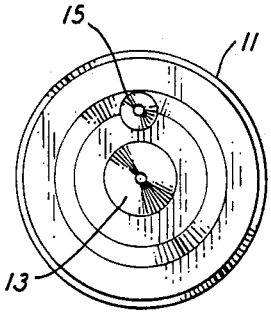
Figure 1B:
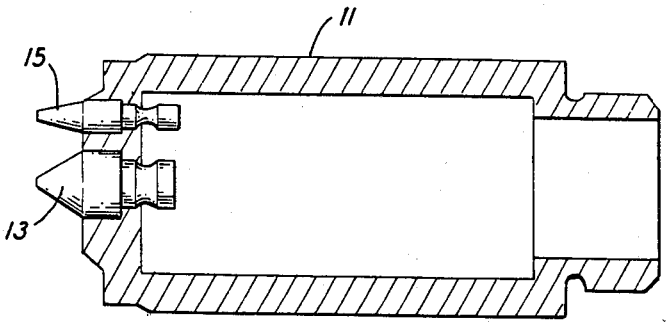

Referring to FIGS. 1*a* and 1*b* there is shown a hollow elongated tubular plunger 11. Projecting from the closed end of plunger 11 are plugs 13 and 15. Plunger 11 is hollow in order to allow it to be water cooled in operation. As those skilled in the art understand plunger 11 is used in the manufacture of three-way lamp bases to press into molten glass which has been deposited into a base shell. For this operation the base shell is held in a prescribed mold with a properly located eyelet and contact ring, as will be explained.

As can be seen from FIG. 1*b* projections 13 and 15 in the past were made of hardened steel plugs fitted into apertures in plunger 11. Because of this the cooling water passing through the interior of plunger 11 was not effective to cool the tips of these projections. As a result these projections soften and wore out rather rapidly.

Figure 2A:
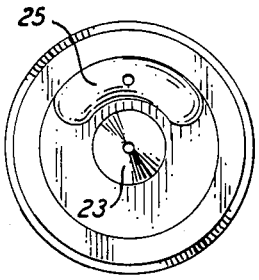
Figure 2B:
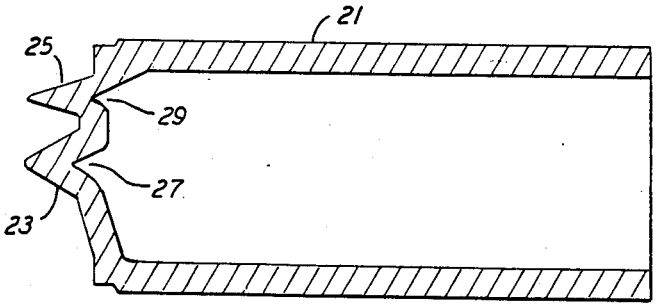

Referring to FIGS. 2*a* and 2*b* there is shown a novel plunger 21. This plunger is made by the lost wax casting process and may be either D2 oil hardenable steel or A2 air hardenable steel. At the present time the latter is preferred. Because this plunger is cast and not machined as prior art plungers were its wall can be made approximately the same prescribed thickness throughout. This is true except at projections 23 and 25. However even at these locations the plunger is internally contoured with dimples 27 and 29 to reduce the thickness of the projections to match more closely the prescribed thickness of the rest of the wall. This aids the cooling of the projections.

Moreover because plunger 21 is cast, off centered projection 25 need not be round. At present it is preferred to make this projection approximately as shown in FIG. 2*a*. The shape of the projection 25 is such that it has a cross-section perpendicular to the longitudinal axis of the plunger which has a longer circumferential dimension than a radial one. Projection 23 has a round cross-section as in the prior art.

Figure 3:
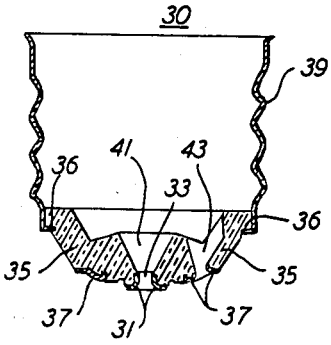
FIG. 3 is a cross-section of a lamp base made in accordance with the invention.
Figure 4:
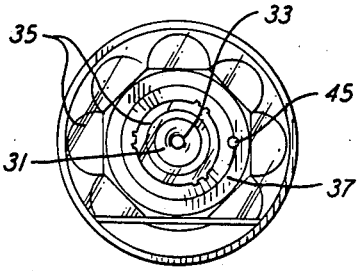
FIG. 4 shows the bottom of the lamp base of FIG. 3.

FIGS. 3 and 4 show lamp base 30 after water cooled plunger 21 has pressed molten glass in a prescribed mold. The glass is hardened in the mold and forms the desired insulation. As can be seen in the center of base 30 is brass eyelet 31 with aperture 33. Surrounding eyelet 31 is glass insulation 35 which separates eyelet 31 from brass contact ring 37. Eyelet 31 is located a predetermined distance below shoulder 36 at the bottom of aluminum shell 39 by glass insulation 35 which surrounds should 36 and extends below it. Contact ring 37 is a fixed distance below shell 39 less than the predetermined distance eyelet 31 is below it.

Projections 23 and 25 when pressed into the molten glass which will become insulation 35 produce recesses 41 and 43. Recesses 41 and 43 are in line with aperture 33 in eyelet 31 and aperture 45 in contact ring 37, respectively. In the manufacturing process these recesses are opened to form apertures in glass 35 in line with apertures 33 and 45. This is done by having slugs of glass which have formed at the bottom of the recesses knocked out by needle like pin plungers.

Apertures 33 and 45 allow contact lead wires to be fed through base 30 in order to contact eyelet 31 and contact ring 37. From plunger 11 (FIG. 1*a* and 1*b*) it can be appreciated that in the past the off centered recess corresponding to 43 was necessarily smaller than the centered recess corresponding to 41. As a result some difficulty was experienced in directing a lead wire into this off centered recess and through the contact ring aperture.

In the present method as in the prior art process plunger 21 is pressed into a gob of a predetermined amount of molten glass deposited inside a threaded tubular shell such as 39 (FIG. 3). The shell is provided with shoulder 36 at one end and is held with this shouldered end down and its opposite open end up in a prescribed mold. An eyelet, such as 31, is located in the mold at the center of the shell a predetermined distance below its shoulder. Also held in the mold is a contact ring, such as 37, which surrounds the eyelet and is located a fixed distance below the shouldered bottom of the shell less than the predetermined distance eyelet 31 is below the shell. When water cooled plunger 21 presses into the molten glass it forces it around the shoulder of the shell and the eyelet, between the eyelet and the contact ring and between the contact ring and the shoulder. Because of the mold and plunger 21 the glass insulation which is formed when the molten glass hardens has the shape shown in FIGS. 3 and 4.

Figure 5:
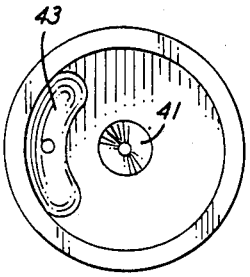
FIG. 5 shows the surface of the glass insulation of a three-way lamp base made in accordance with the invention.

Internally, looking down into shell 39 the insulation's shape is shown in FIG. 5. From this it can be seen that off centered recess 43 in glass insulation 35 has a cross-section perpendicular to the longitudinal axis of shell 39 which decreases smoothly in the direction towards the contact ring, and has a circumferential dimension which is longer than its radial dimension. By increasing the size of this recess in accordance with the invention it will be apparent that it is easier to feed a lead wire through aperture 45 in contact ring 37.

It is understood that various modifications to the above-described arrangement and method will become evident to those skilled in the art and that the arrangement and method described herein is for illustrative purposes and is not to be considered restrictive.

What is claimed is:

1. A base for a three-way lamp including a tubular shell with an open end and an end with a shoulder around it and a round wall about a longitudinal axis, glass insulation around said shoulder and extending outside said shell with a central recess in it, said central recess having a given diameter in a predetermined plane perpendicular to said longitudinal axis, which plane passes through the upper half of said central recess, an eyelet embedded in said glass insulation located in the center of said glass insulation so that the center of the eyelet is aligned with the center of the central recess in said glass insulation, and a contact ring surrounding said eyelet and embedded in said glass insulation, said contact ring being separated from said eyelet and from said shell by said glass insulation, said contact ring having a radial wall with a predetermined width and an aperture in it, said glass insulation having an off centered recess extending through said insulation and having an aperture in line with the aperture in said contact ring, said off centered recess being between the central recess and said round wall of said shell, said insulation having a depth between said contact ring and said shell, said off dimension about said longitudinal axis which is at least as large as said given diameter, and which decreases smoothly in the direction away from said predetermined plane to a narrow opening at said aperture in said contact ring to serve as a guide means for a wire to be fed through said off centered recess for connection to said contact ring.

2. A base for a three-way lamp as in claim 1 wherein said eyelet is located a predetermined distance below said shoulder.

3. A base for a three-way lamp as in claim 2, wherein said contact ring is located below said shoulder a fixed distance less than said predetermined distance.

4. A method of manufacturing a base for a three-way lamp including positioning a tubular shell with an upper open end and a lower end with a shoulder and a round wall disposed around a longitudinal axis with its open end up in a prescribed mold, locating an eyelet in the mold in the center of said shell and below its shoulder a predetermined distance, locating a contact ring in the mold around said eyelet and separate from it, said contact ring having a radial wall with an aperture in it and being located at a fixed distance below said shoulder less than said predetermined distance, depositing a predetermined amount of molten glass into said shell, pressing a metal plunger into said shell to force said glass in a prescribed manner around said shoulder and said eyelet, between said eyelet and said contact ring and between said contact ring and said shoulder, said plunger forming recesses in said glass axially aligned with the aperture of said eyelet and the aperture in the radial wall of said contact ring, said recess in line with the aperture in said eyelet having a given diameter in a predetermined plane perpendicular to said longitudinal axis, which plane passes through the upper half of said central recess, said recess in line with said aperture in said radial wall having a circumferential dimension about said longitudinal axis, which in said predetermined plane is at least as large as said given diameter, and which decreases smoothly in the direction away from said predetermined plane to a narrow opening at said aperture in said contact ring to serve as a guide means for a wire to be fed through said aperture for connection to said contract ring.

5. A method according to claim 4 including pressing a pin through the apertures in said eyelet and said radial wall to form apertures in said recesses.

6. A method according to claim 4 in which said circumferential dimension is larger than said given diameter.

7. A base for a three-way lamp as claimed in claim 1 wherein said circumferential dimension is larger than said given diameter.

8. A base for a three-way lamp as claimed in claim 7 wherein said cross-section with said circumferential dimension also has a radial dimension and said circumferential dimension is larger than said radial dimension.

9. A base for a three-way lamp as claimed in claim 1 wherein said off centered recess has sloping walls which converge towards said apertures in said contact ring.

10. A method of manufacturing a base for a three-way lamp as claimed in claim 1 wherein said off centered recess has sloping walls which converger towards the aperture in said contact ring.

* * * * *